United States Patent [19]

Brack

[11] 4,401,240

[45] Aug. 30, 1983

[54] HAND HELD SPRAY CAN ADAPTER

[76] Inventor: Joe B. Brack, P.O. Box 1119, 1314 Market St., Baytown, Tex. 77520

[21] Appl. No.: 236,769

[22] Filed: Feb. 23, 1981

[51] Int. Cl.[3] ..... B05B 11/00

[52] U.S. Cl. ..... 222/323; 222/474; 403/352; 403/374

[58] Field of Search ..... 222/174, 180, 470–474, 222/323; 220/319, 320, 321; 403/351, 352, 374; 239/375, 525, 532

[56] References Cited

U.S. PATENT DOCUMENTS

| | | | |
|---|---|---|---|
| 2,803,383 | 8/1957 | Dickman et al. . | |
| 2,820,578 | 1/1958 | Dickman | 222/323 |
| 2,868,421 | 1/1959 | Schott . | |
| 2,877,934 | 3/1959 | Wallace . | |
| 2,884,166 | 4/1959 | Vosbikian et al. . | |
| 3,112,849 | 12/1963 | Wallace . | |
| 3,195,934 | 7/1965 | Parrish | 403/374 |
| 3,233,783 | 2/1966 | Thornton | 222/474 |
| 3,237,809 | 3/1966 | Daragan et al. . | |
| 3,304,797 | 2/1967 | Graveley . | |
| 3,506,159 | 4/1970 | Muller . | |
| 3,599,786 | 8/1971 | Osojnak | 220/319 |
| 3,734,357 | 5/1973 | Batistelli et al. | 222/323 |
| 4,098,436 | 7/1978 | Kohlbeck | 222/474 |

FOREIGN PATENT DOCUMENTS

| | | | |
|---|---|---|---|
| 1343881 | 1/1974 | United Kingdom | 222/473 |

*Primary Examiner*—H. Grant Skaggs

*Attorney, Agent, or Firm*—Pravel, Gambrell, Hewitt, Kirk & Kimball

[57] ABSTRACT

A holder for a cannister having a valve which is typically used for aerosol spraying is provided. The holder securely grips a cannister bead and is provided with a handle having a valve actuator for actuating the valve on the cannister. The holder provides improved stability by surrounding and supporting the body of the cannister so that it can be shaken or moved rapidly without disengagement from the cannister.

10 Claims, 20 Drawing Figures

HAND HELD SPRAY CAN ADAPTER

BACKGROUND OF THE INVENTION

1. Field of the Invention

The present invention relates to adapters to be utilized in conjunction with aerosol spray cans particularly of the type providing a pistol grip spray gun attachment.

2. Description of Prior Art

U.S. Pat. Nos. 2,803,383; 2,820,578; 2,868,421; 2,877,934; 2,884,166; 3,112,849; 3,237,809; 3,304,797; and 3,506,159 relate to pistol grip type adapters for use with aerosol spray cans.

As far as is known, all of the spray can holders and adapters in the prior art have certain limitations in stability and ease of use. U.S. Pat. No. 2,803,383 disclosed a holder manufactured of spring steel designed to grip the aerosol can around the raised bead which surrounds the plunger element. That adapter is secured to the cannister by a spring loop of steel or wire which surrounds the uppermost bead of the cannister. That adapter does not provide a secure grip upon the body of the cannister and grips the can at its uppermost point thereby leaving the entire weight of the can below the gripping point. U.S. Pat. No. 2,820,578 disclosed a similar adapter that utilized a flange support member to engage the uppermost bead of the cannister. That adapter was secured to the cannister by a flange partially surrounding the circumference of the uppermost bead on the cannister thereby leaving the majority of the weight of the cannister below the gripping point of the adapter and failing to provide a secure grip upon the cannister.

U.S. Pat. No. 2,868,421 disclosed a pistol grip type adapter wherein the uppermost bead of the cannister was received in a rectangular sleeve member which surrounded half the perimeter of the raised bead. That adapter provided only a partial support for the uppermost bead of the cannister.

U.S. Pat. No. 2,877,934 disclosed a pistol grip type adapter which was secured to the cannister utilizing flexible finger members which engaged the uppermost bead of the cannister.

U.S. Pat. No. 2,884,166 disclosed a pistol grip type adapter which utilized a clamping loop of spring steel to support the cannister from the uppermost bead. U.S. Pat. No. 3,112,849 disclosed a pistol grip type adapter similar to that of U.S. Pat. No. 2,877,934 embodying only a change in the method of joining the handle member to the cannister support member and utilized similar resilient finger flanges to engage the uppermost bead of the cannister.

U.S. Pat. No. 3,237,809 disclosed a pistol grip adapter for use with specially designed aerosol containers and supported them in an inverted position. U.S. Pat. No. 3,304,797 disclosed a pistol grip type holder which was mounted to the cannister utilizing a resilient flange which snapped around the uppermost bead of the cannister. U.S. Pat. No. 3,506,159 disclosed a spray can holder which was mounted to the cannister by a resilient flange member which snapped onto the uppermost bead of the cannister.

As far as known, all of the prior art spray can adapters provide an inadequate grip upon the cannister so that the user cannot shake the cannister or move it quickly without fear of disengaging the adapter from the cannister. All of the known prior patents are designed to grip the cannister at the uppermost raised bead which immediately surrounds the plunger element in the cannister. Gripping the cannister at this point leaves the majority of weight and mass of the cannister below the gripping point, making the composite assembly of the cannister and the holder unbalanced and bottom heavy.

SUMMARY OF THE INVENTION

In contrast to the foregoing, the present invention provides a pistol grip spray can holder which securely grips the cannister around the perimeter or body of the can in a manner which allows the user to shake or move the can rapidly without disengaging the adapter from the cannister. The present invention provides support to the cannister at a point, below the uppermost bead, around the body of the cannister thereby improving the balance and handling characteristics of the assembly. Furthermore, the present invention provides an adapter which may be quickly and easily mounted to the cannister and is readily adapted for manufacture from lightweight materials.

DESCRIPTION OF THE PREFERRED EMBODIMENT

Figure 12:
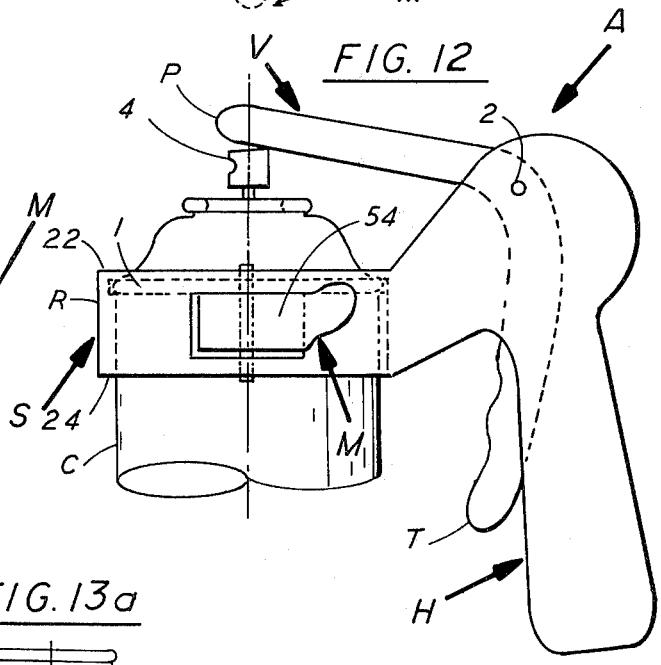
FIG. 12 is a side view of the adapter shown in FIG. 11.
Figure 13A:
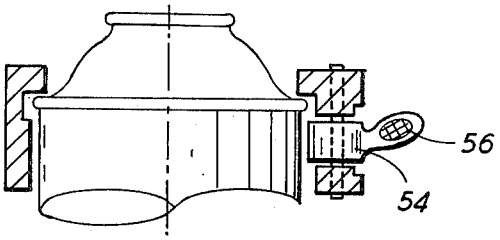
FIG. 13*a* is a frontal cross-sectional view of the embodiment of the invention shown in FIG. 12, with the eccentric cam in disengaged position.

In the drawings, the letter A designates a cannister holder according to the present invention. In FIG. 12 the cannister holder A is further comprised of a handle member H, a cannister support member S, a cannister mounting means M and a valve actuating means V. The cannister holder A may be constructed of any suitable material, with relatively lightweight materials possessing structural rigidity and durability being preferred. The cannister holder A is especially well suited to be manufactured from thermo plastic materials using any one of a number of known techniques such as injection molding or extrusion.

Referring now to the drawings in greater detail, in FIG. 12, valve actuating means V is further comprised of plunger engaging member P and trigger member T. In FIG. 12 valve actuating means V is comprised of a substantially L-shaped one piece lever pivotally mounted to handle member H with pin 2. In this configuration, operation of trigger member T results in valve actuating means V pivoting about pin 2 causing plunger engaging member P to depress plunger 4 of cannister C thereby actuating the cannister discharge valve.

Figure 8:
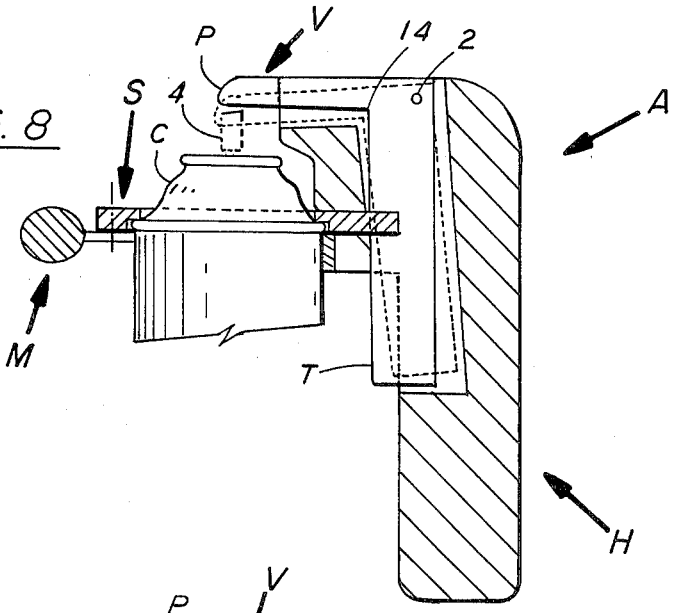
FIG. 8 is a side view of another embodiment of an adapter according to the present invention showing the plunger engaging element in initial disengaged position in full view and the plunger engaging element in engaging position in phantom.
Figure 9:
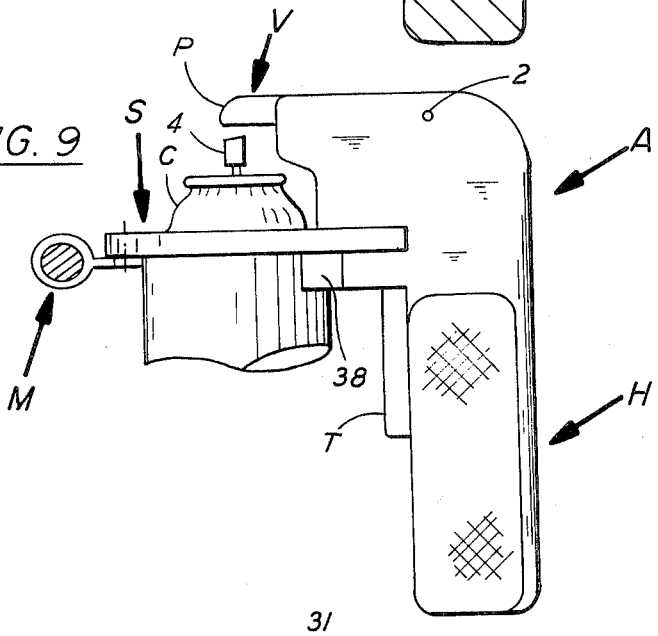
FIG. 9 is a side view of an embodiment of an adapter according to the present invention utilizing an eccentric cam as a cannister mounting means.
Figure 10:
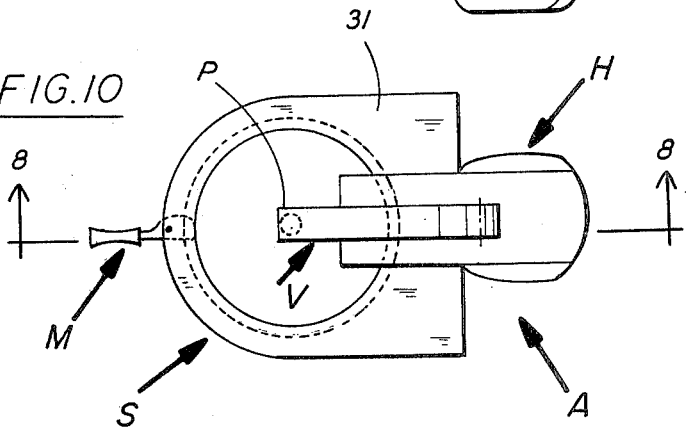
FIG. 10 is a top view of the embodiment of the present invention shown in side view in FIG. 9.

In FIG. 8, another embodiment of valve actuating means V is shown comprising a substantially L-shaped lever having a plunger engaging member P and trigger member T. In this embodiment valve actuating means V is also constructed of a single piece; however, the shape of the L-shaped lever is generally rectangular, with members P and T forming a substantially right angle at their vertex 4.

Figure 1:
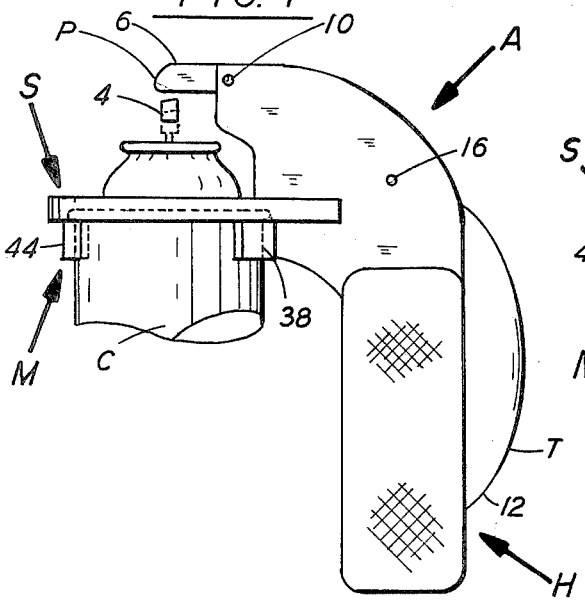
FIG. 1 is a side view of an adapter according to the present invention shown in position upon a cannister.
Figure 3:
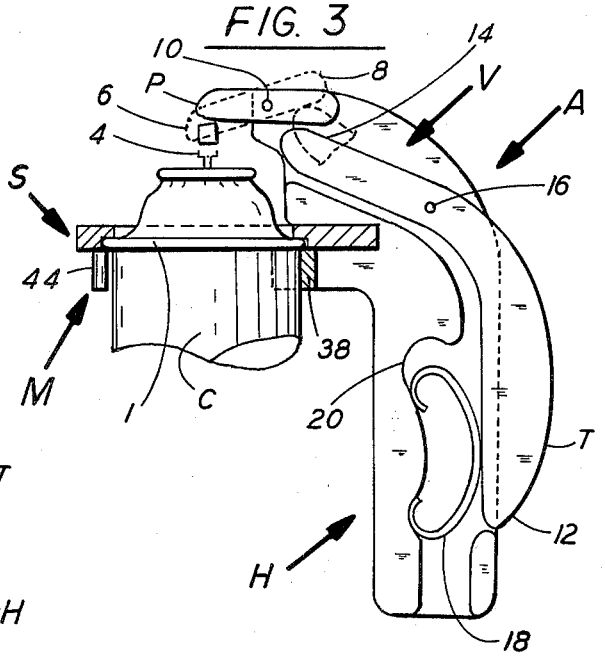
FIG. 3 is a cross-sectional view of an embodiment of an adapter according to the present invention shown mounted in position on a cannister.
Figure 2:
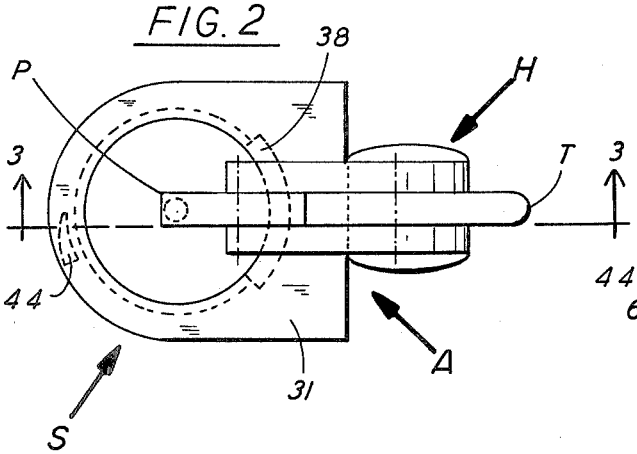
FIG. 2 is a top view of an adapter according to the present invention.
Figure 4:
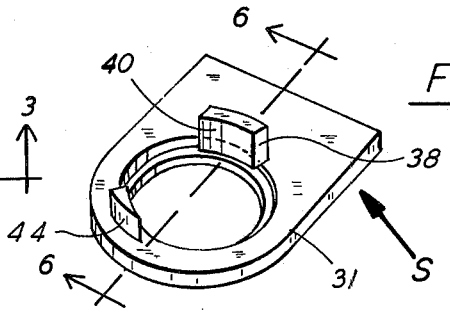
FIG. 4 is an isometric view of the cannister support member of one embodiment of the present invention.

In FIG. 3 valve actuating means V is comprised of plunger engaging member P and trigger member T. In this embodiment, plunger engaging member P is an elongated lever having a first, plunger engaging, end 6 and a second, trigger engaging, end 8. Plunger engaging member P is pivotally mounted to handle member H, at pin 10, between end 6 and end 8. Trigger member T is an angular lever having a lower end 12 and an upper end 14. Trigger member T is pivotally mounted to handle member H at pin 16. Trigger member T is biased outwardly from handle member H by spring 18. Any suitable means of biasing trigger member T outwardly from handle member H such as a coil spring, or a fluid operated piston would suffice, however in the preferred embodiment spring 18 is formed from spring steel or similar resilient material and is adapted to be housed in cavity 20 in handle member H. In this embodiment, trigger member T extends from the rear portion of handle member H to be operated in the palm of the user. The user by grasping the handle member H in his hand is able to actuate valve plunger element 4 by strengthening his grip around handle member H. In this configuration the user is not required to operate the trigger with a single finger, and the use of a double system of levers reduces the pressure required upon trigger member T to actuate valve plunger element 4. The combination of these two features results in significantly reducing the actuation pressure required of the user, thereby making operation of the device less tiring. This configuration has also been found to provide the user with improved control over the actuation of plunger element 4.

The components of valve actuating means V, including plunger engaging member P and trigger member T may be manufactured of any material possessing sufficient structural rigidity, with lightweight materials such as aluminum or thermoplastics being preferred. Any means of pivotally mounting plunger engaging member P and trigger member T to handle member H would suffice, however in the preferred embodiment pins 10 and 16 extend through preformed holes in plunger engaging members P and T, respectively and are secured to handle member H. Thus in operation, the user depresses end 12 of trigger member T thereby pivoting trigger member T about pin 16 causing end 14 of trigger member T to engage and raise end 8 of plunger engaging element P as shown in phantom in FIG. 3. As end 8 of plunger engaging element P is engaged by end 14 of trigger member T, end 6 of plunger engaging member P engages plunger element 4 of cannister C thereby actuating the cannister discharge valve.

Figure 14:
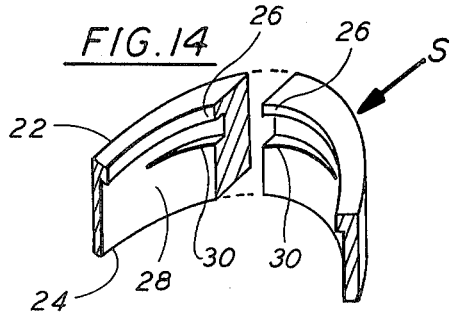
FIG. 14 is a cross-sectional view of the cannister support member of the embodiment of the invention shown in FIG. 11.

In FIG. 12, cannister support member S is shown as a cylindrical ring, forming a forward extension of handle member H. Support member S is adapted to receive cannister C. In FIG. 14, support member S is shown in cross-section, having an upper opening 22 and a lower opening 24. Upper opening 22 is shown restricted by lip or lateral surface 26 which extends from wall 28 while the lower opening 24 is unrestricted. It is preferred that lip 26 extend completely around the inner circumference of end 22 of support member S, however provision of a lip or similar restriction at at least three points around the inner circumference of end 22 of support member S would suffice.

Figure 5:
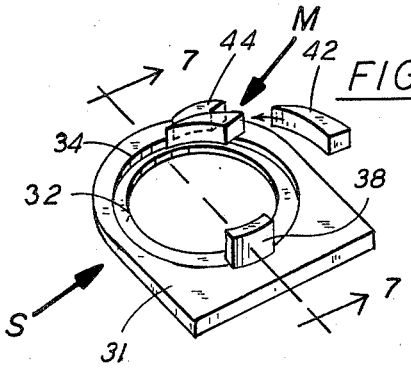
FIG. 5 is an isometric view of the cannister support member of one embodiment of the present invention showing the cannister support wedge in initial and final position.
Figure 6:
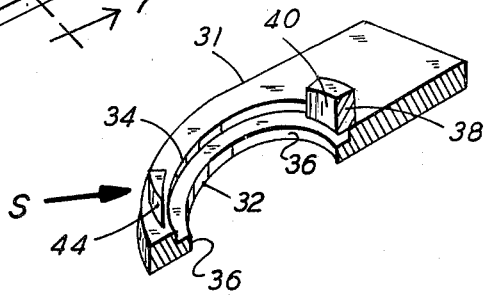
FIG. 6 is a cross-sectional view of the cannister support member of one embodiment of the present invention without the cannister support wedge in place.

FIGS. 4, 5, 6, and 7 show various aspects of a different embodiment of support member S as viewed from below. As can be seen in FIG. 6, support member S is a horizontal plate member 31 having a restricted opening 32 and an unrestricted opening 34. Lip 36 is adapted to engage raised bead 1 of cannister C when cannister C is received in unrestricted opening 34. Thus cannister C may be received in support member S from below but may not pass through support member S, as lip 36 engages raised bead 1 of cannister C thereby prohibiting passage of cannister C through restricted opening 32. In the preferred embodiment, support member S also includes shoulder member 38 as seen in FIGS. 4, 5, 6, and 7. Shoulder member 38 is secured to support member S and extends partially over unrestricted opening 34. Shoulder member 38 is an arcuate member adapted to engage raised bead 1 of cannister C from below when cannister C is received into support member S. Inner face 40 of shoulder 38 is adapted to mate with the body of cannister C when cannister C is received in support member S. As seen in FIG. 6, shoulder 38 and lip 36 form a channel adapted to receive a portion of raised bead 1 of cannister C when cannister C is received in support member S. Thus, in use, cannister C is inserted into support member S, raised bead 1 being partially received in the channel formed by shoulder 38 and lip 36, and then cannister C is finally secured to support member S utilizing mounting means M as seen in FIG. 5.

Figure 7:
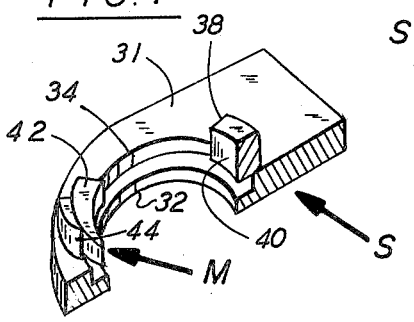
FIG. 7 is a cross-sectional view of the cannister support member of one embodiment of the present invention showing the cannister support wedge in position.
Figure 18:
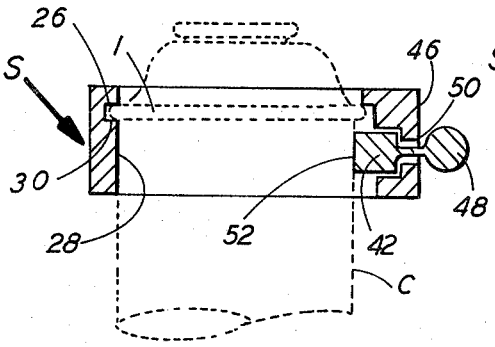
FIG. 18 is a vertical cross-sectional view of the cannister support ring of the embodiment of the invention shown in FIG. 15 showing the cannister support wedge in engaging position.
Figure 19:
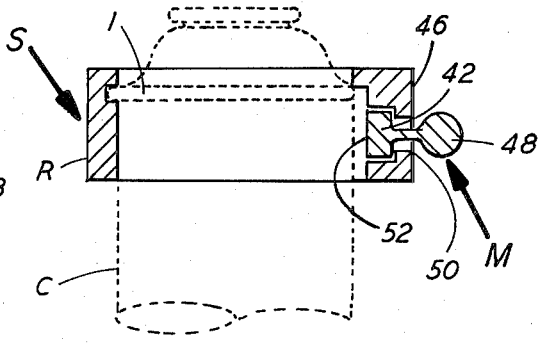
FIG. 19 is a vertical cross-section of the cannister support ring of the embodiment of the invention shown in FIG. 15 showing the cannister support wedge in disengaged position.
Figure 16:
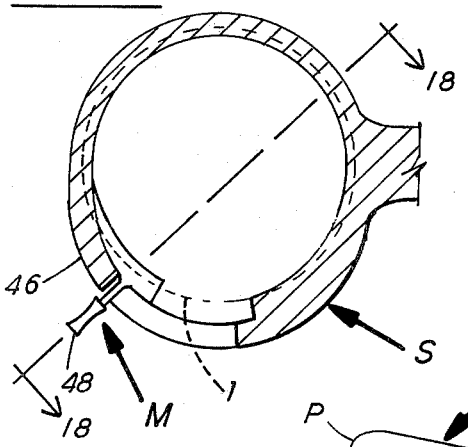
FIG. 16 is a cross-sectional view of the cannister support ring of the embodiment shown in FIG. 15 with the cannister support wedge in engaging position.
Figure 17:
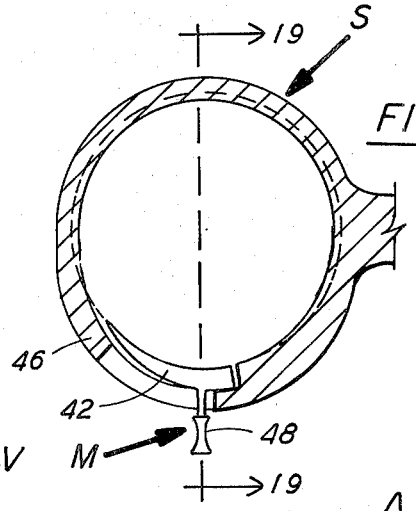
FIG. 17 is a cross-sectional view of the embodiment of the present invention shown in FIG. 15 with the cannister supporting wedge in disengaged position.
Figure 15:
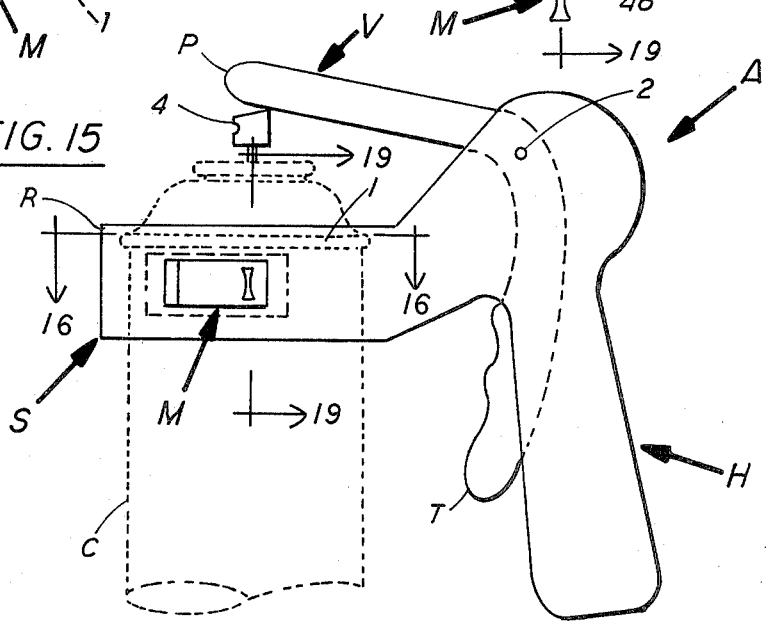
FIG. 15 is a side view of another embodiment of adapter according to the present invention.

Mounting means M may be any means suitable for selectively engaging raised bead 1 of cannister C after cannister C is received in support member S. As seen in FIGS. 5, 6, and 7, mounting means M includes arcuate wedge member 42 and arcuate shoulder member 44. In this embodiment, after cannister C is received in support member S, wedge member 42 is wedged between the wall of cannister C and shoulder member 44. The shoulder member 44 is secured to support member S. Wedge member 42 engages raised bead 1 of cannister C from below and frictionally engages shoulder 44 and the wall of the cannister C below raised bead 1. Thus mounting means M in conjunction with shoulder 38 fully support cannister C by engaging a substantial portion of raised bead 1 of cannister C from below. This sliding wedge mounting means may also be used in conjunction with the cylindrical ring embodiment of the support member S as seen in FIGS. 15, 16, 17, 18 and 19. In this configuration, arcuate wedge 42 is slidably mounted in the wall 46 of support member S. In this embodiment, wedge member 42 is provided with handle 48 which extends through aperture 50 in wall 46 of support member S (As seen in FIGS. 18 and 19). In this configuration, cannister C may be received in support member S when wedge member 42 is in a disengaged position as shown in FIGS. 17 and 19. Once the cannister C has been received in support member S, wedge member 42 may be slid into engaging position as seen in FIGS. 16 and 18 whereby wedge member 42 engages a portion of raised bead 1 of cannister C from below. The combination of support from wedge member 42 and the channel formed by lip 26 and shoulder 30 (as seen in FIG. 18) provides support for cannister C by engaging raised bead 1 around a substantial portion of its perimeter. Additional stability is provided by wall 28 of support member S and face 52 of wedge member 42 which engage the external wall of cannister C when cannister C is received in support member S.

Figure 11:
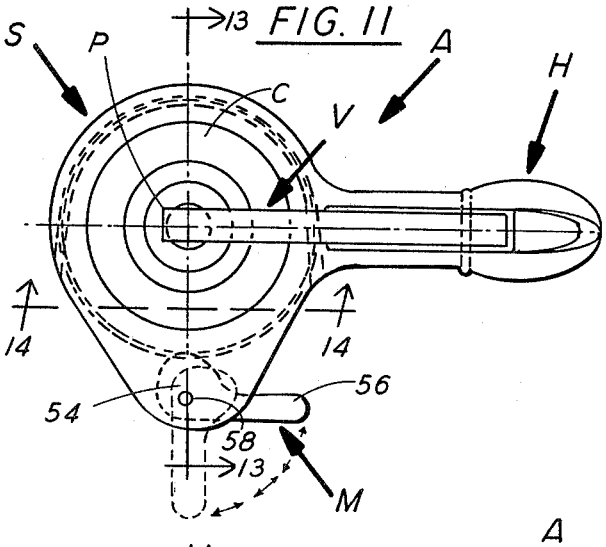
FIG. 11 is a top view of another embodiment of adapter according to the present invention shown in position on a cannister.
Figure 13:
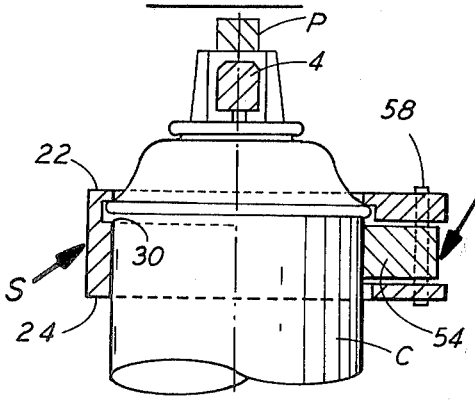
FIG. 13 is a frontal cross-sectional view of the embodiment of the present invention shown in FIG. 12, with the eccentric cam in engaging position.

Mounting means M may also be in the form of an eccentric cam as shown in FIGS. 8, 9, 10, 11, 12 and 13 and 13*a*. As seen in FIGS. 11, 12 and 13, mounting means M is comprised of an eccentric cam 54 pivotally mounted to support member S with pin 58 and having a handle 56. As seen in FIG. 11, eccentric cam 54 may be pivoted about pin 58 from an initial disengage position as shown in phantom to a final engaging position as shown in full view. In use, cannister C is received in support member S while cam 54 is in a disengaging position. Once cannister S has been received in support member S, cam 54 is rotated about pin 58 to engaging position as shown in full view in FIG. 11. When in final engaging position, cam 54 provides support along the lower edge of raised bead 1 of cannister C in conjunction with shoulder 30 of wall 28 in support member S. Thus in combination, cam 54 and shoulder 30 engage a substantial portion of raised bead 1 of cannister C from below, thereby providing substantial support to cannister C. Further support and stability are derived from lip 26 which engages the entire perimeter of raised bead 1 of cannister C and wall 28 which engages a substantial portion of the outer wall of cannister C.

In summary, the adapter A according to the present invention may be quickly, easily and securely attached to the body of an aerosol cannister by engaging the perimeteral raised bead which surrounds the upper portion of the body of such a cannister. By supporting the cannister from this point, improved balance and handling characteristics are attained over the prior art, in that support is maintained from a point substantially closer to the center of mass of the cannister. Additionally, by surrounding the body of the can with support member S, and engaging a substantial portion of the perimeter of the raised bead 1 of the cannister C, the adapter A is much more securely fastened to the cannister C than in any of the devices found in the prior art. This enables the user to freely shake the cannister utilizing the handle member A without fear of disengaging the adapter A from the cannister C.

The foregoing disclosure and description of the invention are illustrative and explanatory thereof and various changes in the size, shape and materials as well as in the details of the preferred embodiment may be made without departing from the spirit of the invention.

I claim:

1. A holder for a pressurized fluid cannister of the type having a discharge valve at the upper end of the cannister, and an external raised bead at the upper end of the cannister, comprising:

a handle member;

a cannister support member secured to said handle member and adapted to receive the cannister;

said cannister support member comprising a continuous ring adapted to surround the perimeter of the cannister, said ring having a lateral surface to provide a restricted opening of a smaller size than the size of the external bead on the cannister;

said ring being open for its full extent below said restricted opening and being at least as large as the size of the bead to permit the cannister to be received in said ring for engagement with said lateral surface of said restricted opening;

said support member having clamp means for removably mounting the cannister to said support member comprising an eccentric cam, pivotally mounted to said cannister support member, adapted to selectively engage the raised bead of the cannister; and valve actuating means operably connected to said handle member for actuating the discharge valve.

2. The holder of claim 1, wherein said valve actuating means comprises:

a plunger engaging member, having a portion thereof overlapping the cannister support member adapted to engage the discharge valve of the cannister;

a trigger member, having a portion thereof disposed adjacent to said handle member for operation by the user;

a means for operably connecting said plunger engaging member and said trigger member so that operation of said trigger member by the user is transmitted to said plunger engaging member to actuate the discharge valve in said cannister.

3. The holder of claim 2, wherein:

said plunger engaging member comprises a first leg of a substantially L-shaped lever;

said trigger member comprises a second leg of said substantially L-shaped lever; and said L-shaped lever is pivotably mounted to said handle member.

4. The holder of claim 3, wherein said L-shaped lever is pivotally mounted to said handle member at the vertex of said L-shaped lever.

5. The holder of claim 2, wherein:

said plunger engaging member comprises a first lever having a first end and a second end, said first lever being pivotally mounted to said handle member between said first end and said second end;

said trigger member comprises a second lever, having an upper end and a lower end, said trigger member being pivotally mounted to said handle member between said upper end and said lower end;

and wherein said upper end of said trigger member engages said second end of said plunger engaging member, so that operation of said trigger member causes said first end of said plunger engaging member to engage the discharge valve in the cannister.

6. The holder of claim 5, wherein said lower end of said trigger member is disposed to the rear of said handle member.

7. The holder of claim 2, wherein said valve actuating means further comprises a means for outwardly biasing said trigger member.

8. The holder of claim 7, wherein said biasing means comprises a spring disposed between said trigger member and said handle member.

9. The holder of claim 1, wherein said cylindrical ring has a shoulder adapted to engage the raised bead of the cannister, formed therein below said restricted opening and extending partially around the inter circumference of said cylindrical ring, said shoulder and said restricted opening forming a channel to receive the raised bead of the cannister.

10. A holder for a pressurized fluid cannister of the type having a discharge valve at the upper end of the cannister, and an external raised bead at the upper end of the cannister, comprising:

a handle member;

a cannister support member secured to said handle member and adapted to receive the cannister;

said cannister support member comprising a continuous ring adapted to surround the perimeter of the cannister, said ring having a lateral surface to provide a restricted opening of a smaller size than the size of the external bead on the cannister;

said ring being open for its full extent below said restricted opening and being at least as large as the size of the bead to permit the cannister to be received in said ring for engagement with said lateral surface of said restricted opening;

said support member having clamp means for removably mounting the cannister to said support member comprising an arcuate wedge member, slidably mounted to said support member, and adapted to selectively engage the raised bead of the cannister.

* * * * *